United States Patent [19]

Eaton et al.

[11] Patent Number: 4,483,623

[45] Date of Patent: Nov. 20, 1984

[54] MAGNETIC STIRRING APPARATUS

[75] Inventors: David L. Eaton, Horseheads; William P. Vann, Beaver Dams, both of N.Y.

[73] Assignee: Corning Glass Works, Corning, N.Y.

[21] Appl. No.: 485,476

[22] Filed: Apr. 15, 1983

[51] Int. Cl.[3] ..... B01F 7/18; B01F 13/08

[52] U.S. Cl. ..... 366/247; 366/273

[58] Field of Search ..... 366/273, 274, 242, 243, 366/244, 245, 247, 249, 250, 251, 347, 286

[56] References Cited

U.S. PATENT DOCUMENTS

| | | | |
|---|---|---|---|
| 1,328,652 | 1/1920 | Ehlers | 366/347 |
| 1,504,867 | 8/1924 | Cannon | 366/286 |
| 2,932,493 | 4/1960 | Jacobs | 366/274 |
| 2,996,363 | 8/1961 | Ruyak | 366/273 |
| 3,572,651 | 3/1971 | Marker | 366/274 |
| 3,622,129 | 11/1971 | Mazawski | 366/274 |
| 3,649,465 | 3/1972 | Scharf et al. | 366/273 |
| 3,744,764 | 7/1973 | Sedam | 366/274 |
| 3,854,704 | 12/1974 | Balas | 366/274 |
| 4,286,885 | 9/1981 | Uibel et al. | 366/347 |
| 4,289,854 | 9/1981 | Feder et al. | 435/286 |
| 4,382,685 | 5/1983 | Pearson | 366/242 |

*Primary Examiner*—Philip R. Coe

*Assistant Examiner*—Michael Knick

*Attorney, Agent, or Firm*—B. D. Voyce

[57] ABSTRACT

An improved magnetic stirring apparatus capable of suspending solids in a liquid medium comprising: a vessel for containing fluids and solids, having walls, a bottom, and an opening; a stirrer having a magnetic impeller and a shaft, a means for rotating the magnetic impeller; and a closure; wherein the improvement is characterized by:

(a) the shaft having;
  (i) an upper portion; and
  (ii) a narrower lower portion; an upper bearing surface being formed where the lower portion extends outwardly to the upper portion;

(b) an elongated shaft support member which
  (i) is attached to the closure; and
  (ii) has an aperture dimensioned and configured to receive the lower shaft portion and allow free rotation, opposed aperture margins forming a lower bearing surface; and (c) a sling bearing formed by the upper bearing surface engaging the lower bearing surface in the direction of the vessel bottom, thereby suspending the stirrer.

8 Claims, 7 Drawing Figures

42
46

42
44
5
34
36
38
5

26
24
22
20

44
40
38

38
34
36

32

16
14
18
42
48
50
20
44
38
10
2
32
2
12

MAGNETIC STIRRING APPARATUS

TECHNICAL FIELD

The present invention relates to magnetic stirring devices. More particularly, it discloses a stirrer having a novel bearing, adjustable in height. The disclosed invention is particularly useful in applications where solids must be suspended in a liquid medium with a minimum of shear force, such as in microcarrier tissue cell culture.

BACKGROUND ART

The present inventors are not the first to disclose a suspended magnetic stirrer wherein the stirrer, i.e., shaft and impeller, is totally enclosed within a vessel. An early disclosure is U.S. Pat. No. 2,932,493 to Jacobs. In FIG. 3, Jacobs describes a beverage mixer having a magnetic stirrer suspended from a lid by means of a ball and socket joint.

A second disclosure of interest is U.S. Pat. No. 3,854,704 to Balas. A gimbaled bearing (ball and socket joint) attached to a closure is illustrated in FIGS. 8 and 9. As used in cell culture, this stirrer also is envisioned to operate in an arcuate manner.

Finally, a recently issued patent, U.S. Pat. No. 4,289,854 to Tolbert et al., relates an allegedly novel stirrer using a flexible sail impeller. Used in the suspension culturing of mammalian cells, the impeller centrally rotates about a bearing suspended from a stopper. The bearing consists of two parts: a downwardly projecting, rigid stationary shaft which flares outwardly to provide a lower bearing surface; and a rotatable sleeve member internally journalled to form an upper, rotating bearing surface.

While all of these disclosures are relevant to any discussion of enclosed magnetic stirrers, they do not disclose or suggest the novel and non-obvious features of the present invention.

DISCLOSURE OF THE INVENTION

The present invention comprises an improved magnetic stirring apparatus capable of suspending solids in a liquid medium with a minimum of shear force. It is particularly useful in suspended microcarrier cell culture, where low shear forces and low revolution per minute (RPM) operation are desirable.

The instant stirrer has conventional stirrer elements such as: a vessel for containing fluids and solids having walls, a bottom, and an opening at the top; a stirrer having a shaft and a finned magnetic impeller; and a closure. However, the present invention has additional elements which, when combined with the above elements in a novel and non-obvious way, create an effective, yet inexpensive stirrer.

These additional elements invention are a variable thickness shaft and an elongated shaft support member, which are shaped and assembled in the following manner.

The shaft has an upper and a lower portion. The cross-sectional area of the lower portion is smaller than that of the upper portion. An upper bearing surface is formed on the shaft where the lower portion extends into the upper portion.

A lower bearing surface is formed by an elongated and apertured shaft support or sling member. The aperture is dimensioned and configured to receive the upper shaft portion when force-fitted or otherwise distorted.

The stirrer is assembled by distorting the sling member, sliding the upper shaft portion through the aperture, and suspending that portion on the shoulders or margins of the aperture.

In an alternative embodiment, the aperture also is dimensioned and configured in another part to receive the upper shaft portion, forming a keyhole. The upper portion of the shaft is inserted into the keyhole part of the aperture, the stirrer is suspended onto the sling member at a point where only the narrower lower portion is received, and when the upper bearing surface engages the lower bearing surface in the direction of the vessel bottom, a sling bearing is formed.

The above stirrer can provide optimal conditions for the growth of cells either in suspension or attached to microcarrier beads known to the art. An important advantage to this configuration is the ease of assembly and the inexpensive production costs which make it ideal for a pre-sterilized, disposable cell growth system. Conventional suspended cell culture systems have had to deal with bulky, complicated designs which were not economically conducive to a throw-away mode of operation.

BEST MODE OF CARRYING OUT THE INVENTION

Figures 1, 2, 3, 4, 5, 6, 7:
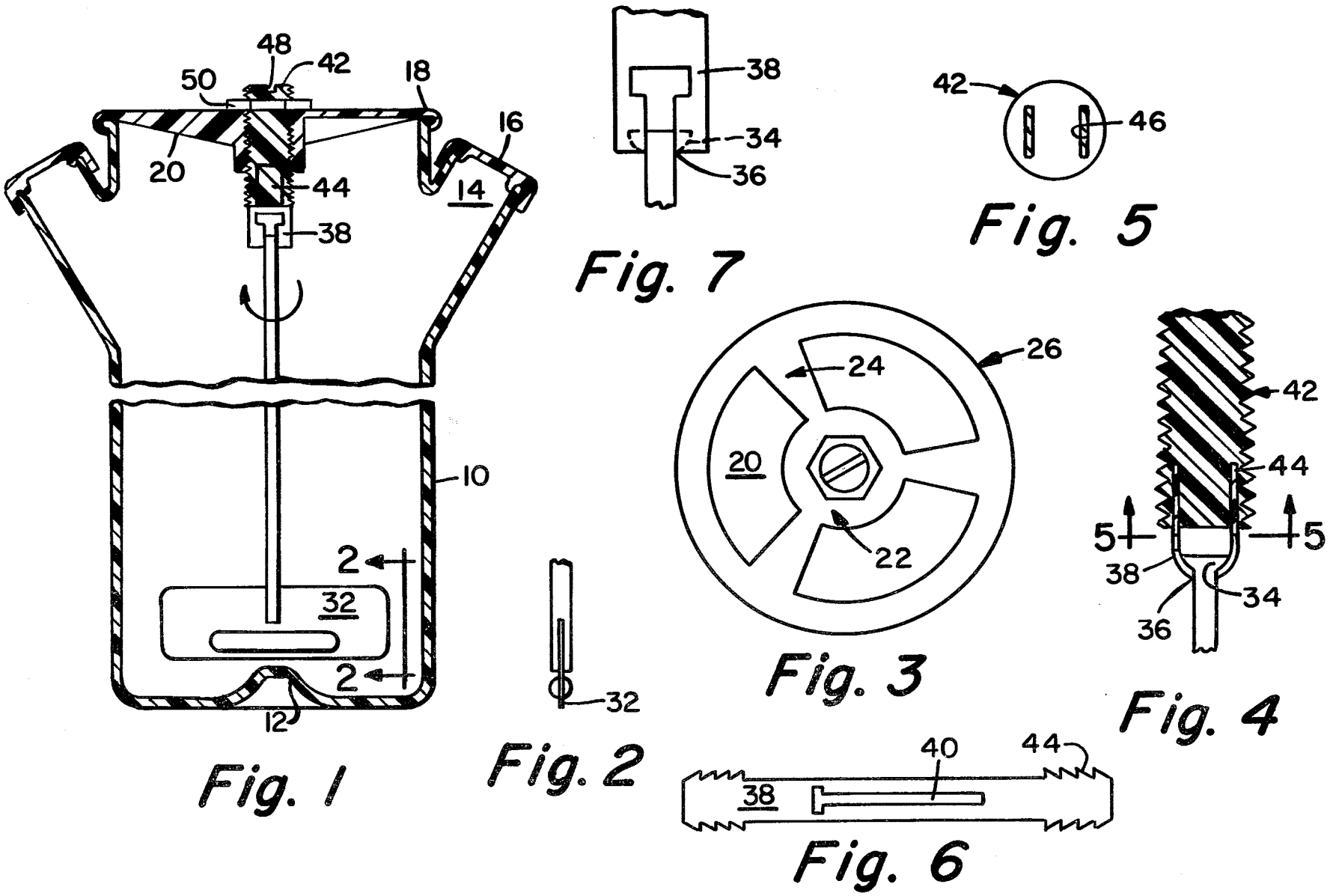
FIG. 1 is a cross-sectional view of the assembled magnetic stirrer.
FIG. 2 is a side view of the impeller, along the (2—2) plane of FIG. 1.
FIG. 3 is an overhead view of the closure.
FIG. 4 is a cross-sectional view of the stirrer sling bearing and the adjustable stirrer height means.
FIG. 5 is an end-on view of the adjustable stirrer height means along the (5—5) plane of FIG. 4.
FIG. 6 is an overhead view of the elongated shaft support member when not attached to the closure.
FIG. 7 is a close-up view of the sling bearing of FIG. 1.

In a preferred embodiment for use in suspended microcarrier cell culture, the present invention begins, in FIG. 1, with a vessel (10) having walls, a bottom, and an opening at the top. A projection (12) rises from the center of the bottom to a height of about a half inch. The corners are radiused where the walls meet the bottom. On opposite upper wall surfaces are side ports (14) covered with closures (16) made from materials which restrict bar cell contaminants from entering the vessel.

The opening is covered by a snap-fitting closure (18), having incorporated therein, an oxygen and carbon dioxide gas-permeable, cell contaminant impermeable membrane (20) made, for example, from polyethylene. As best seen in FIG. 3, a preferred closure comprises a structural array of members capable of suspending a stirrer and the gas-permeable membrane (20). The array has a central disc (22) connected by radial arms (24) to an annulus (26). A distinct advantage to this design is that respiratory gasses generated during cell culturing can be exchanged without fear of contamination. Such an exchange is especially desirable where non-ambient gas concentrations could cause a media pH shift.

A sling bearing suspends a magnetic stirrer from the closure. As seen in FIGS. 1, 4, and 7, the bearing comprises two opposing surfaces, an upper bearing surface

(34) at the upper end of the shaft, and a lower bearing surface (36) at the point of suspension of the shaft on an appropriately apertured and elongated shaft support or sling member (38). Bearing assembly is easy and quick, the upper shaft end being snapped into the aperture of the support member.

More particularly, FIG. 6 reveals a shaft support member dimensioned and configured from a strip of low friction material, such as Teflon®, with a T-slotted aperture (40) capable of receiving the shaft therethrough, yet not allowing the shaft to slip through the aperture when suspended. Of course, this requires that the upper shaft end be correspondingly dimensioned at the upper bearing surface, e.g., beveled, such that while an upper portion of the shaft can slip through the T-slot, it is wide enough to rest upon at least opposed margins or shoulders of that portion of the aperture not having the T-slot, i.e., the lower bearing surface.

An alternative embodiment of the bearing does not call for a T-slot aperture in the shaft support. Instead, either the shaft support and/or the shaft is made of a pliable material. In one case, the upper bearing surface of a pliable shaft deforms enough to be push-fitted into a narrower aperture, but once through, regains its original shape. On the other hand, the support can be sufficiently pliable to permit a shaft to be push-fitted into a narrower aperture which also regains its original form once the upper bearing surface is through the aperture. In either case, no T-slot is required.

Another advantage to the present invention can be found in the way the sling bearing is connected to the closure. In a preferred embodiment, the bearing attaches to an externally-controlled, vertically adjustable member or bushing (42). This permits a suspended microcarrier cell culture system wherein one can adjust the clearance of the impeller to the vessel bottom to suit a particular cell line without having to expose the vessel interior to ambient air.

FIGS. 1 and 4 detail a preferred stirrer height adjustment means. The sling bearing support (38) has serrated edges (44) on the lateral edges of both ends. A cylindrical, circumferentially threaded adjustment member (42) is correspondingly slotted on its bottom face (46) (FIG. 5) whereby the serrated edges may be inserted into spaced slots. Proper slot spacing ensures a symmetrical, arcuately-shaped sling support upon which the inserted shaft easily rotates. The adjustment member (42) is received by a correspondingly threaded aperture in the central disc portion (22) of the closure.

The stirrer impeller height can be adjusted by turning the adjustment member. For convenience, the upper end of the member can be either grooved (48) for a screwdriver or in the shape of a knurled cap (not shown) which can be turned by hand. Another optional item is a lock nut (50) which threads onto the external portion of the adjustment member. When snugged against the closure, inadvertent adjustment of the stirrer is avoided.

The impeller (32) features a single vertical blade with a magnet implanted or encased within. Lying in the same plane as the impeller and centered under the sling bearing, the stirrer operates in a central rotating manner when coupled with a conventional magnet rotating means. The shaft/impeller assembly can be either a snap-fitting arrangement, as shown in FIG. 2, where the impeller is pushed into a bottom-slotted shaft, or it can be a unitary construction (not shown).

As claimed, the present invention provides an inexpensive, presterilizable, and disposable magnetic stirrer capable of very low RPM operation and low shear forces. This can be critical when culturing sensitive cell lines. Suspended fibroblast cells such as MRC-5 and HFF are extremely sensitive to shear, dying when they become detached from support surfaces. The following examples demonstrate the present stirrer's performance.

EXAMPLE 1

MRC-5 Cell Culturing

The MRC-5 cell line as deposited in the American Type Culture Collection (ATCC) of Rockville, Md., was cultured in the present invention as shown in the Figures. An indented spinner apparatus made by Bellco, see U.S. Pat. No. 3,622,129, was used as a control for comparison purposes. In both cases the MRC-5 cells were attached to Cytodex 3® microcarrier beads made by Pharmacia. Conventional culturing practices and media were used throughout.

TABLE 1

| Run No. | Impeller Clearance (inches) | Impeller Size+ | Cell Yield |
|---|---|---|---|
| 1 | ½ | R | 6.74 |
| 2 | ½ | L | 6.34 |
| 3 | ⅛ | R | 4.38 |
| 4 | ⅛ | L | 6.02 |
| 5* | ⅛ | R | 6.08 |
| 6* | ⅛ | R | 6.26 |

*designates a Bellco stirrer
L means a 2.6 cm × 8.0 cm paddle
R means a 3.5 cm × 8.95 cm paddle
All runs were made for 7 days at 24 RPM
Cell yield is in a ratio of amount recovered divided by amount seeded.

EXAMPLE 2

MDCK Cell Culturing

The MDCK cell line as deposited in the ATCC was cultured for 5 days with the method of Example 1, using a similar control. The results were as follows except the impeller speed was 28 RPM.

TABLE 2

| Run No. | Impeller Clearance (inches) | Impeller Size | Cell Yield |
|---|---|---|---|
| 1 | ⅛ | R | 16.00 |
| 2 | ⅛ | R | 16.35 |
| 3 | ⅛ | R | 15.91 |
| 4 | ⅛ | L | 15.45 |
| 5 | ⅛ | L | 17.15 |
| 6 | ⅛ | L | 16.21 |
| 7 | ½ | R | 16.95 |
| 8 | ½ | R | 14.83 |
| 9 | ½ | R | 18.08 |
| 10 | ½ | L | 18.06 |
| 11 | ½ | L | 16.81 |
| 12 | ½ | L | 17.87 |
| 13* | ⅛ | R | 16.51 |
| 14* | ⅛ | R | 15.14 |
| 15* | ⅛ | R | 19.35 |

*designates a Bellco stirrer
L means a 2.6 cm × 8.0 cm paddle
R means a 3.5 cm × 8.95 cm paddle
Cell yield is in a ratio of the amount recovered divided by the amount seeded.

Having described the invention with particular reference to preferred form, it will be obvious to those skilled in the art to which the invention pertain, that, after understanding the invention, various changes and modifications may be made without departing from the spirit and scope of the invention as defined by the appended claims.

We claim:

1. An improved magnetic stirring apparatus capable of suspending solids in a liquid medium comprising: a vessel for containing fluids and solids, having walls, a bottom, and an opening; a suspend stirrer having a magnetic impeller and a shaft, a means for rotating the magnetic impeller; and a closure; wherein the improvement is characterized by:

(a) the shaft having;

(i) an upper portion having a first diameter; and (ii) a lower portion extending upwardly and outwardly toward said upper portion and having a second diameter less than the first diameter; an upper bearing surface being formed where said lower portion extends outwardly to said upper portion;

(b) an elongated planar shaft support member having two support ends, an aperture and two opposed aperture margins on either side of said aperture and between said support ends; said support member being attached to the closure at the support ends and projects downwardly thereform, forming a sling; and said aperture being dimensioned and configured between the support ends to receive the lower shaft portion and allow free rotation of said suspended stirrer, said opposed aperture margins forming a lower bearing surface for engaging the upper bearing surface; and (c) a sling bearing formed by the lower bearing surface engaging the upper bearing surface in the direction of the vessel bottom, thereby suspending the stirrer.

2. The apparatus recited in claim 1 wherein the bearing surfaces are made of low friction materials.

3. The apparatus recited in claim 1 wherein the closure comprises:

(a) a bearing support structure comprising:

(i) an annulus about the opening;

(ii) a central disc, for attachment of the shaft support to the closure, positioned above the center of the vessel bottom; and (iii) at least two radial arms connecting the annulus with the disc; and (b) a gas-permeable membrane covering the remainder of the closure which is impermeable to cell culture contaminents.

4. The apparatus recited in claim 1 further characterized by a means for adjusting the bearing height with respect to the vessel walls.

5. The apparatus recited in claim 1 wherein the liquid medium is stirred at speeds of from about 10–100 revolutions per minute.

6. The apparatus recited in claim 1 wherein the impeller has fins vertically oriented to form an angle between the shaft axis and the fin of about 0°–180°.

7. The apparatus recited in claim 1 wherein the vessel walls have resealable side ports.

8. The apparatus recited in claim 4 wherein the bearing adjustment means comprises:

(a) a movable, vertical adjustment member which has external threads;

(b) a correspondingly threaded central opening in the closure into which the adjustment member is threaded; and (c) an attachment means which connects the adjustment member to the shaft support;

whereby movement of the adjustment member is translated to a movement of the shaft support bearing surface.

* * * * *

UNITED STATES PATENT AND TRADEMARK OFFICE

CERTIFICATE OF CORRECTION

PATENT NO. : 4,483,623

DATED : November 20, 1984

INVENTOR(S) : David L. Eaton, et al.

It is certified that error appears in the above-identified patent and that said Letters Patent is hereby corrected as shown below:

Column 2, line 51, delete "restrict"; and

Column 5, line 5, change "suspend" to --suspended--.

Signed and Sealed this

*Thirtieth* Day of *July 1985*

[SEAL]

*Attest:*

DONALD J. QUIGG

*Attesting Officer* *Acting Commissioner of Patents and Trademarks*